US005384918A

United States Patent [19]

Leighton et al.

[11] Patent Number: 5,384,918

[45] Date of Patent: Jan. 31, 1995

[54] PLUNGER DEVICE

[75] Inventors: Lisa M. Leighton, 1937 Sundance La., Costa Mesa, Calif. 92627; Brian D. Stearns, Roseville, Calif.

[73] Assignee: Lisa M. Leighton, Dana Point, Calif.

[21] Appl. No.: 74,327

[22] Filed: Jun. 8, 1993

[51] Int. Cl.[6] ..... E03D 9/00

[52] U.S. Cl. ..... 4/255.05; 4/255.06

[58] Field of Search ..... 4/255.03, 255.05, 255.06, 4/255.12

[56] References Cited

U.S. PATENT DOCUMENTS

| | | | |
|---|---|---|---|
| 729,156 | 5/1903 | Geiger | 4/255.03 |
| 1,154,055 | 9/1915 | Reeves | 4/255.12 |
| 1,734,206 | 11/1929 | Fisch | 4/255.05 |
| 2,233,378 | 2/1941 | Wilson | 4/255.05 |
| 2,312,826 | 3/1943 | Leyden | 4/255.06 |
| 4,144,598 | 3/1979 | Li | 4/255.06 |
| 4,320,539 | 3/1982 | Li | 4/255.06 |
| 4,756,480 | 7/1988 | Fish | 4/255.06 |
| 4,768,237 | 9/1988 | Torti | 4/255.05 |
| 5,020,166 | 6/1991 | Davenport | 4/255.06 |

OTHER PUBLICATIONS

"Hydro-Plunger" brochure of Richard Langenfeld Sales date unknown.

*Primary Examiner*—Robert M. Fetsuga

*Attorney, Agent, or Firm*—Stetina Brunda & Buyan

[57] ABSTRACT

A plunger device for forcing waste through a drain line of a plumbing fixture. The plunger device generally comprises an elongate tubular member having a top end and a bottom end. Fluidly connected to the top end is a handle member which is adapted to be fluidly coupled to a water supply source. Fluidly connected to the bottom end is a plunger member which is sized and configured to be positionable over and form a fluid-tight seal about a drain opening of the fixture in a manner when water is directed from the supply source, through the plunger device, and into the drain line.

10 Claims, 3 Drawing Sheets

Fig. 6
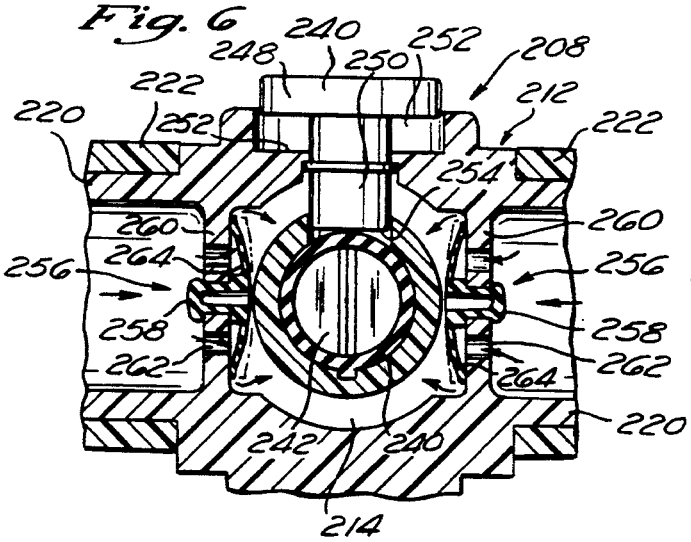
Fig. 7
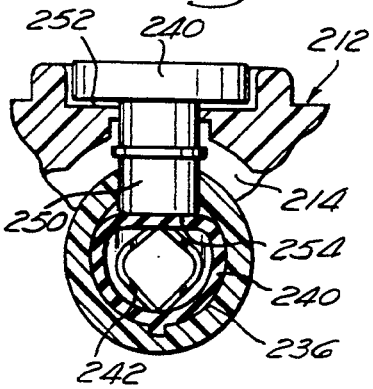
Fig. 8a
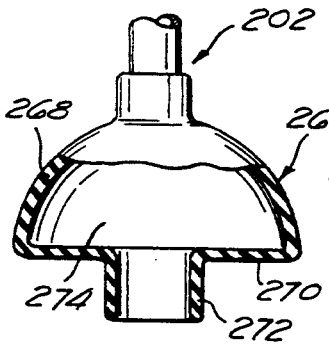
Fig. 8b
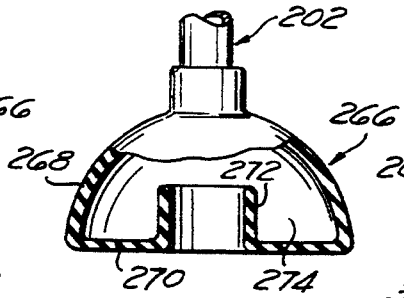
Fig. 8c
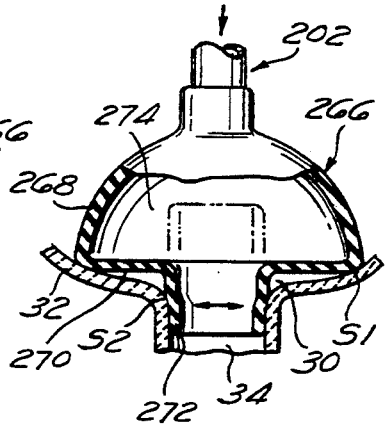
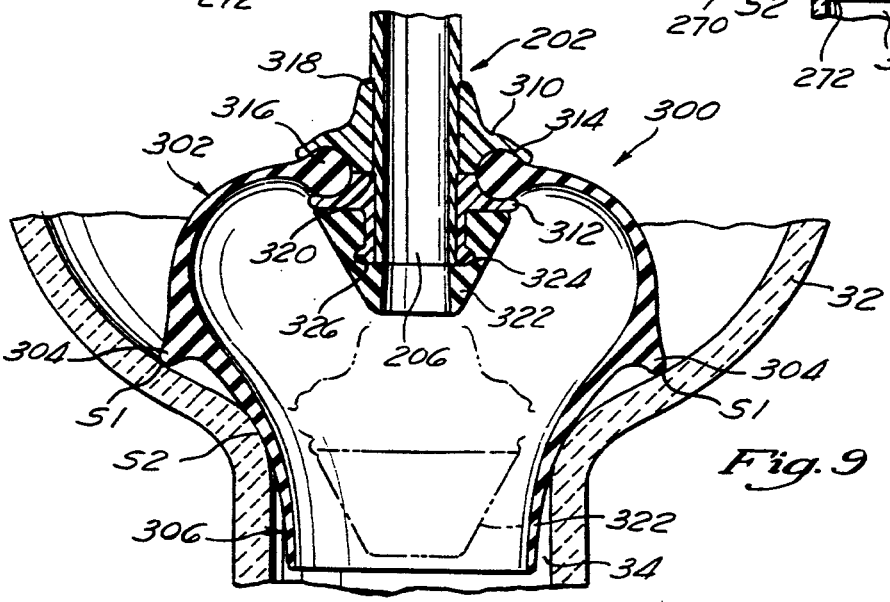
Fig. 9

PLUNGER DEVICE

FIELD OF THE INVENTION

The present invention relates generally to plumbing equipment, and more particularly to a plunger device for forcing waste through the drain line of a plumbing fixture such as a sink or toilet bowl.

BACKGROUND OF THE INVENTION

A problem frequently associated with plumbing fixtures such as toilet bowls and sinks is the inadvertent clogging of the drain lines associated therewith. In this respect, toilet bowl drain lines are often clogged by an over-abundance of toilet paper, while sinks are commonly clogged by debris such as hair, food waste products, etc. In the prior art, it is well known to use various types of chemical agents which are poured into the clogged basin to chemically dissolve the clog. However, a major disadvantage associated with the use of chemical agents is that these products are typically highly caustic and present health risks if ingested or exposed to the skin of the product user.

As an alternative to the use of the chemical agents, it is also well known to use a "plunger" which typically comprises an elongate wooden handle member having a cup-like member formed of rubber attached to one end thereof. The plunger is used by placing the open end of the cup-like member over the clogged drain and forcing the handle downwardly so as to invert the cup-like member, thus forcing the volume of water disposed therein into the clogged drain for purposes of dislodging the clog. Thereafter, the cup-like member is returned to its original, uninverted orientation so as to allow the same to be re-filled with a quantity of water. The aforementioned process is then repeated until such time as the clog is dislodged from the drain line.

Though the use of the "plunger" presents certain advantages over the use of chemical agents, these devices possess certain deficiencies which detract from their overall utility. Foremost of these deficiencies is the frequent inability of the plunger to dislodge the clog within the drain line. In this respect, when the plunger handle is forced downwardly, only a relatively small volume of water is forced into the drain opening and hence the drain line. Additionally, the pressure at which the volume of water is forced into the drain line is also relatively low. Oftentimes, the forcing of the small water volume into the drain line at a relatively low pressure does not remove the clog from within the drain line, thus necessitating the use of alternative clog removing methods. The present invention overcomes these and other deficiencies associated with prior art plungers by providing a plunger device which may be used as an alternative to chemical agents and which introduces a high volume of water at high pressure into the drain line to remove a clog therefrom.

SUMMARY OF THE INVENTION

In accordance with first and second embodiments of the present invention, there is provided a plunger device for forcing waste through a drain line of a plumbing fixture such as a toilet bowl or sink. The plunger device generally comprises an elongate tubular member having a top end and a bottom end. The top end is adapted to be fluidly coupled to a water supply source, while the bottom end includes a plunger member connected thereto. The plunger member defines an interior chamber which is in fluid communication with the tubular member. The plunger member further includes a fluid outlet port and is sized and configured to be positionable over and form a fluid-tight seal about a drain opening of the basin in a manner wherein water is directed from the supply source, through the plunger device, and into the drain line via the outlet port.

Fluidly connected to the top end of the tubular member is a handle assembly which is adapted to be fluidly coupled to the supply source. Attached to the handle assembly intermediate the tubular member and the supply source is a valve member which may be actuated between open and closed positions for selectively controlling the flow of water from the supply source into the drain line.

In the first and second embodiments, the plunger member includes a generally bell-shaped configuration defining a first annular sealing surface which is adapted to form a first seal against a portion of the interior surface of the basin surrounding the drain opening. The plunger member further includes a generally cylindrical portion which extends downwardly from the first sealing surface and includes the outlet port disposed therein. The cylindrical member is sized having an outer diameter dimension less than the outer diameter dimension of the first sealing surface and is further sized to be receivable into the drain opening and form a second seal against a portion of the inner surface of the drain line. The tubular member and handle member are preferably fabricated from polyvinylchloride (PVC) tubing, though other materials may be utilized as an alternative. Additionally, the plunger member is preferably fabricated from rubber, though other flexible materials may also be utilized.

In accordance with a third embodiment of the present invention, there is provided a plunger device comprising an elongate, tubular member having a valve assembly fluidly coupled to the top end thereof which is adapted to have a water supply source fluidly coupled thereto. A pair of elongate, tubular handle members are attached to the valve assembly in the manner wherein the handle members extend perpendicularly relative the tubular member in opposed relation. The valve assembly is selectively actuatable between open and closed positions, and operable to channel water from the water supply source into the tubular member when in the open position. Attached to the bottom end of the tubular member is a plunger member comprising a bell-shaped portion having a generally circular lower surface and a generally cylindrical portion extending downwardly from the lower surface. The cylindrical portion-has an outer diameter dimension exceeding the inner diameter dimension of the drain line such that the cylindrical portion forms a seal against the inner surface of the drain line when received thereinto. Like the plunger member previously described, the outlet port of the plunger member is disposed within the cylindrical portion.

In the third embodiment, the valve assembly comprises a housing defining an interior chamber. Disposed intermediate the interior chamber and the tubular member is a check valve which is adapted to prevent the back-flow of water from the tubular member into the interior chamber. Additionally, disposed intermediate the interior chamber and the water supply source is a water inlet valve, which is adapted to channel water from the supply source to the interior chamber when actuated to the open position. In this respect, disposed within the housing and cooperatively engaged to the water inlet valve is an actuation button which, when pressed, is operable to actuate the inlet valve to the open position. The valve assembly further comprises a pair of air inlet valves which are disposed intermediate the interior chamber and the handle members and are operable to create a vacuum break and close the water inlet valve by placing the interior chamber in fluid communication with ambient air when the fluid pressure in the interior chamber is less than atmospheric pressure. The water inlet and check valves are preferably duck bill valves, while the air inlet valves are preferably umbrella valves.

In the third embodiment, the cylindrical portion of the plunger member is selectively invertible and disposed within the interior cavity thereof when inverted. In this respect, the cylindrical portion is preferably initially inverted when the plunger device is used, and is caused to be moved to its original, extended orientation in a manner forming a seal against the inner surface of the drain line when the actuation button is pressed and water is directed through the plunger device.

BRIEF DESCRIPTION OF THE DRAWINGS

These as well as other features of the present invention will become more apparent upon reference to the drawings wherein:

FIG. 6(*a*) is a cross-sectional view of the water inlet valve of the valve assembly;

FIG. 7(*a*) is a cross-sectional view of the check valve of the valve assembly;

FIG. 8(*a*) is a partial cross-sectional view of the plunger member of the third embodiment, illustrating the cylindrical portion thereof in its original, extended orientation;

FIG. 8(*b*) is a partial cross-sectional view of the plunger member of the third embodiment, illustrating the cylindrical portion thereof in the inverted orientation;

FIG. 8(*c*) is a partial cross-sectional view of the plunger member of the third embodiment, illustrating the manner in which the cylindrical portion thereof is moved from the inverted to the extended orientations to form a seal in the drain line; and FIG. 9 is a cross-sectional view of a plunger member which may be utilized in conjunction with the plunger device constructed in accordance with the third embodiment, as an alternative to the plunger member shown in FIGS. s(*a*)-(*c*).

DETAILED DESCRIPTION OF THE PREFERRED EMBODIMENT

Figure 1:
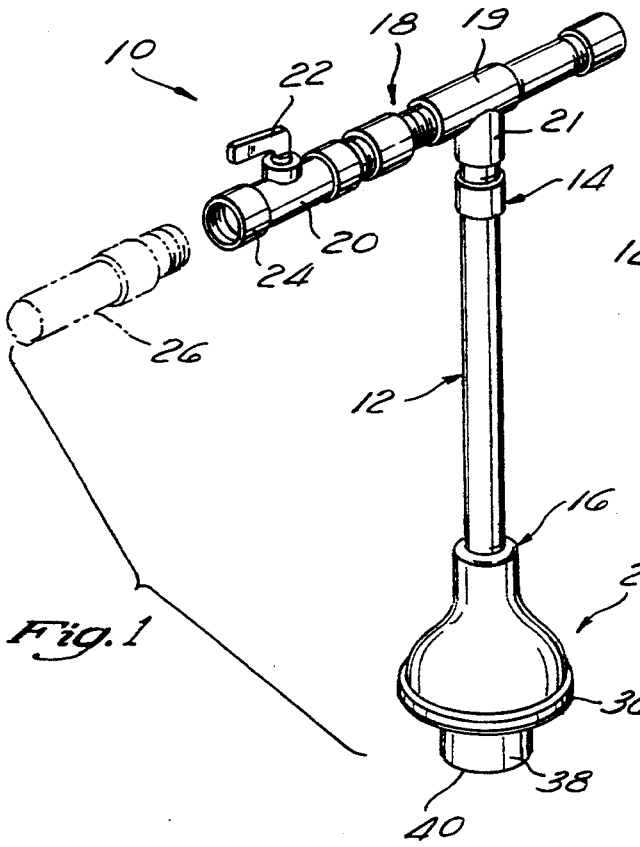
FIG. 1 is a perspective view of a plunger device constructed in accordance with a first embodiment of the present invention.

Referring now to the drawings wherein the showings are for purposes of illustrating preferred embodiments of the present invention only, and not for purposes of limiting the same, FIG. 1 perspectively illustrates a plunger device 10 constructed in accordance with a first embodiment of the present invention. In the first embodiment, plunger device 10 generally comprises an elongate, tubular member 12 having a top end 14 and a bottom end 16.

Fluidly connected to the top end 14 of the tubular member 12 is a tubular handle member 18. The handle member 18 has a generally T-shaped configuration and defines a horizontal portion 19 having a vertical portion 21 extending perpendicularly from approximately the center thereof. As seen in FIG. 1, the vertical portion 21 of handle member 18 is connected to the top end 14 of the tubular member 12 in a manner wherein the tubular member 12 also extends perpendicularly relative horizontal portion 19. The vertical portion 21 is preferably threadably connected to the tubular member 12, though other attachment methods may also be utilized. Fluidly coupled to one end of the horizontal portion 19 is a valve member 20 which may be actuated between an open and closed position via the turning of a handle 22. Disposed on the end of the valve member 20 opposite that fluidly coupled to handle member 18 is a hose bib connector 24 which is adapted to be fluidly coupled to a water supply source 26 (shown in phantom) such as a standard garden hose. As will be recognized, when the supply source 26 is coupled to the hose bib connector 24, the actuation of the valve member 20 to the open position via the handle member 22 allows water to pass from the supply source 26 into the tubular member 12. Thus, the actuation of the valve member 20 between the open and closed positions is operable to selectively control the flow of water from the supply source 26 into the tubular member 12.

Figure 2:
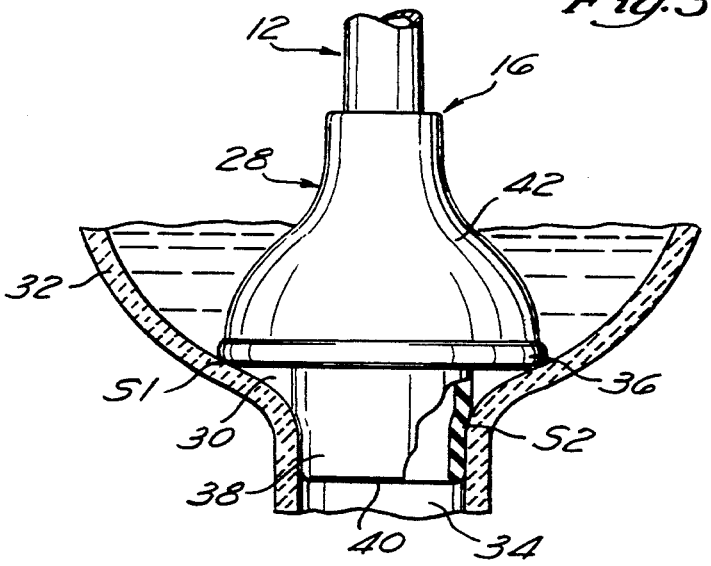
FIG. 2 is a cross-sectional view illustrating the manner in which the plunger member of the plunger device is sealed over a drain opening of a water-retaining basin.

Attached to the bottom end 16 of tubular member 12 is a plunger member 28 which is sized and configured to be positionable over and form a fluid-tight seal about a drain opening 30 of a plumbing fixture 32 in a manner wherein water is directed from the supply source 26, through the plunger device 10, and into a drain line 34 of the basin 32. In the preferred embodiment, the plunger member 28 has a generally bell-shaped configuration and includes an upper portion 42 defining a first annular sealing surface 36 which is adapted to form a first seal S1 against a portion of the interior surface of the basin 32 surrounding the drain opening 30. Extending downwardly from the first sealing surface 36 is a generally cylindrical portion 38 having an outer diameter dimension less than the outer diameter dimension of the first sealing surface 36. Disposed in the bottom surface 40 of cylindrical portion 38 is a fluid outlet port. The outer diameter dimension of the cylindrical portion 38 is preferably sized to exceed the inner diameter dimension of the drain line 34 so that the cylindrical portion 38 forms a second seal S2 against a portion of the inner surface of the drain line 34 when received into the drain opening 30, as seen in FIG. 2.

In the preferred embodiment, the plunger member 28 is hollow and thus defines an interior cavity which is in fluid communication with the tubular member 12. Additionally, the plunger member 28 is preferably fabricated from a flexible material such as rubber so as to allow the upper portion 42 thereof to be collapsed upon the downward movement of the tubular member 12. Both the tubular member 12 and handle member 18 are preferably fabricated from PVC tubing, though other materials may be utilized as an alternative.

In utilizing the plunger device 10, the valve member 20 is initially actuated to the closed position, and the supply source 26, i.e. garden hose, fluidly coupled to the handle member 18 via the hose bib connector 24. Thereafter, the ends of the horizontal portion 19 of the handle member 18 which extend perpendicularly relative the tubular member 12 are grasped by the hands of the user, with the plunger member 28 being lowered to the drain opening 30 in the basin 32.

The plunger device 10 is then manipulated so as to force the cylindrical portion 38 of the plunger member 28 into the drain opening 30 and hence into the drain line 34. The receipt of the cylindrical portion 38 into the drain line 34 is limited by the abutment of the first sealing surface 36 against the interior surface of the basin 32 surrounding the drain opening 30. Thereafter, the valve member 20 is actuated to the open position via the handle 22 so as to allow water to flow from the supply source 26, through the plunger device 10, and into the drain line 34 via the outlet port disposed within the cylindrical portion 38.

As water is flowing from the supply source 26 into the drain line 34, constant downward pressure is applied to the handle member 18 by the user so as to maintain the first sealing surface 36 in a sealed engagement with the interior surface of the basin 32. As will be recognized, due to the formation of the first seal S1 by the first sealing surface 36 and the second seal S2 by the cylindrical portion 38, water is forced into the drain line 34 at line pressure, which is typically in the range of 50 to 90 psi. Oftentimes, this pressure will in and of itself suffice to force the clog out of the drain line 34.

In the event the line pressure of the supply source 26 does not cause the clog to be removed from within the drain line 34, an additional volume of water may be forced into the drain line 34 to facilitate the clog removal. Since the plunger member 28 is hollow, the interior chamber defined therein is filled with water when the valve member 20 is actuated to the open position. Advantageously, the volume of water contained within the interior chamber of the plunger member 28 may be forced into the drain line 34 at high pressure by thrusting the handle member 18 downwardly in a conventional manner so as to collapse the bell-shaped upper portion 42 of the plunger member 28. Thereafter, the upper portion 42 may be returned to its original configuration by pulling upwardly on the handle member 18, thus allowing the interior chamber to be refilled with water via the supply source 26. As can be appreciated, the seals S1 and S2 need not be broken to allow the interior chamber to be re-filled with water due to the continuous flow of water facilitated by the opening of the valve member 20. The aforementioned process may then be repeated until such time as sufficient water pressure is applied to remove the clog. Importantly, the use of the present plunger device 10 allows a significantly greater volume of water to be forced into the drain line 34 at a significantly greater pressure than that which is obtainable through the use of a conventional plunger. After the clog has been dislodged, the valve member 20 is actuated to the closed position and the plunger device 10 removed from within the basin 32.

Figure 3:
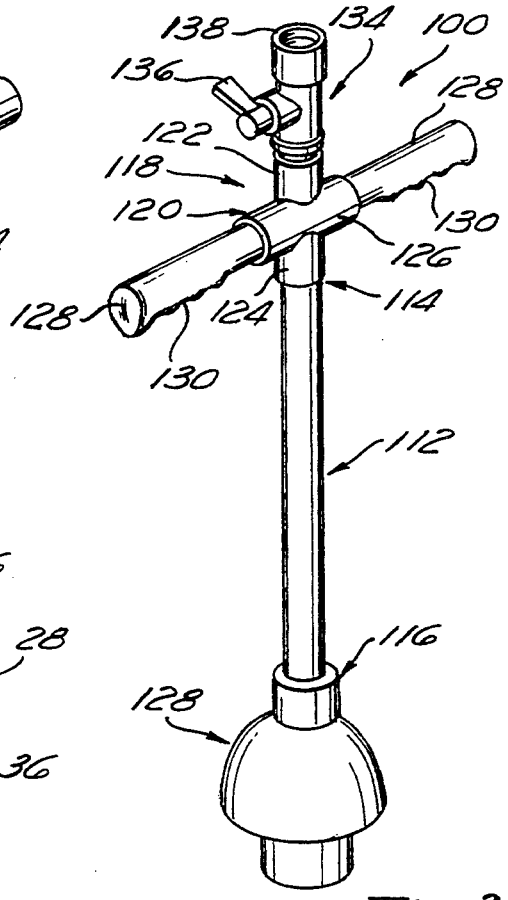
FIG. 3 is a perspective view of a plunger device constructed in accordance with a second embodiment of the present invention.

Referring now to FIG. 3, perspectively illustrated is a plunger device 100 constructed in accordance with a second embodiment of the present invention. Like the plunger device 10 previously described, the plunger device 100 also comprises an elongate, tubular member 112 having a top end 114 and a bottom end 116. Attached to the bottom end 116 of the tubular member 112 is a plunger member 128 identical to the plunger member 28 previously described. Fluidly connected to the top end 114 of the tubular member 112 is a handle assembly 118.

In the second embodiment, handle assembly 118 comprises a hollow adapter member 120 defining an upper, internally threaded tubular portion 122, a lower tubular portion 124 coaxially aligned with the upper tubular portion 122, and a pair of opposed, horizontally oriented, coaxially aligned tubular portions 126. Importantly, the adapter member 120 is formed in a manner wherein the tubular portions 122, 124 and 126 disposed therein are in fluid communication with each other. Rigidly attached to the adapter member 120 are a pair of identically configured handle members 128. In the second embodiment, each of the handle members 128 is attached to the adapter member 120 via the receipt of a cylindrical end thereof into a respective one of the horizontally oriented tubular portion 126. Thus, as seen in FIG. 3, the handle members 128 extend horizontally from opposite sides of the adapter member 120 when attached thereto. Additionally, each of the handle members 128 is preferably hollow and formed to include finger grip recesses 130 along the lower portion thereof.

The handle assembly 118 is fluidly connected to the top end 114 of the tubular member 112 via the receipt of the top end 114 into the lower tubular portion 124 of the adapter member 120. Due to the configuration of the adapter member 120, when the handle assembly 118 is attached to the tubular member 112, the handle members 128 extend generally perpendicularly relative the tubular member 112.

Fluidly coupled to the adapter member 120 is a valve member 134 which may be actuated between open and closed positions via the turning of a handle 136. Particularly, the valve member 134 is coupled to the adapter member 120 via the threadable engagement of the lower portion thereof into the upper aperture 122. Disposed on the end of the valve member 134 opposite that threadably coupled to adapter member 120 is a hose bib connector 138 which is adapted to be fluidly coupled to a water supply source such as a standard garden hose. Due to the fluid communication between the tubular portions 122, 124 and 126 of the adapter member 120, the actuation of the valve member 134 to the open position via the handle member 136 when a supply source is coupled to the hose bib connector 138 allows water to flow from the supply source into the tubular member 112. Thus, the actuation of the valve member 134 between the open and closed positions is operable to selectively control the flow of water from the supply source into the tubular member 112. In the second embodiment, the plunger device 100 is utilized in the same manner as previously described with respect to the plunger device 10.

Figure 4:
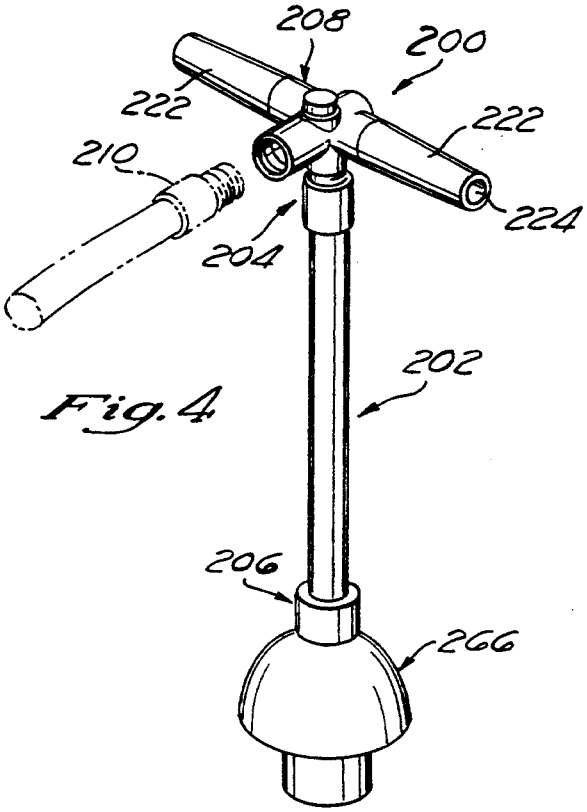
FIG. 4 is a perspective view of a plunger device constructed in accordance with a third embodiment of the present invention.

Referring now to FIG. 4, perspectively illustrated is a plunger device 200 constructed in accordance with a third embodiment of the present invention. Like the plunger devices 10, 100 previously described, the plunger device 200 also comprises an elongate, tubular member 202 having a top end 204 and a bottom end 206. Fluidly coupled to the top end 204 of the tubular member 202 is a valve assembly 208, which is adapted to have a water supply source 210 such as a conventional garden hose fluidly coupled thereto.

Figure 6A:
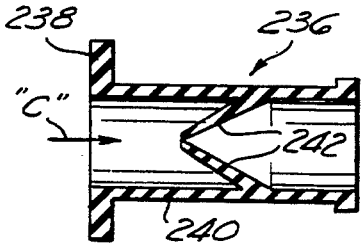
FIG. 6 is a cross-sectional view of the upper portion of the valve assembly taken along line 6-6 of FIG. 5, illustrating the water inlet valve in the closed position.
Figure 7A:
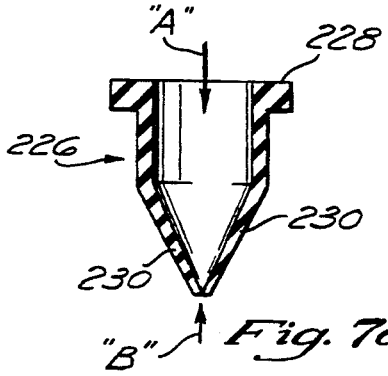
FIG. 7 is a cross-sectional view of the upper portion of the valve assembly, illustrating the water inlet valve as actuated to the open position.
Figure 5:
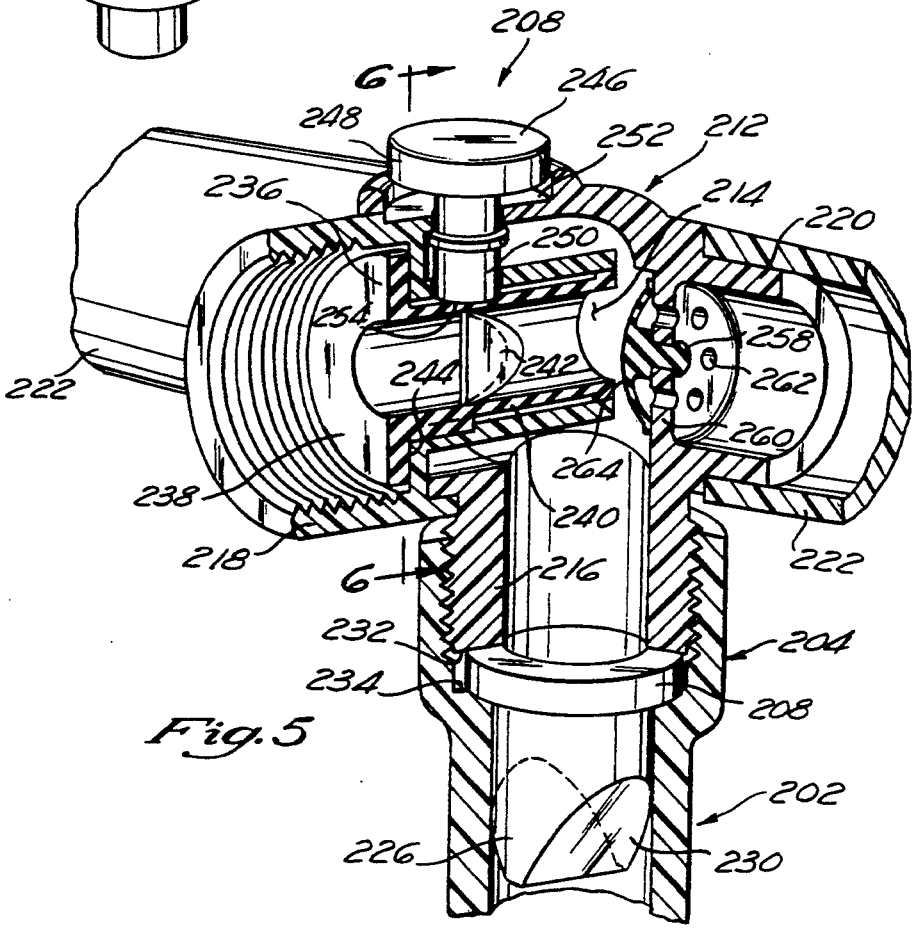
FIG. 5 is a cross-sectional, perspective view of the valve assembly used in the plunger device constructed in accordance with the third embodiment.

Referring now to FIGS. 5–7, the valve assembly 208 generally comprises a housing 212 defining an interior chamber 214. The housing 212 further defines a downwardly extending, externally threaded bonnet portion 216 which is threadably received into the top end 204 of the tubular member 202. In this respect, the top end 204 preferably has an enlarged, internally threaded configuration which is adapted to receive the bonnet portion 216 of the housing 212. The housing 212 further includes a horizontally oriented, internally threaded bonnet portion 218 which is adapted to threadably receive the water supply source 210. In addition to the bonnet portions 216, 218, the housing 212 also defines a pair of horizontally oriented, cylindrically configured flange portions 220 which extend outwardly from the interior chamber 214 in opposed, coaxially aligned relation.

Attached to the housing 212 of the valve assembly 208 are a pair of elongate, tubular handle members 222. The handle members 222, which are identically configured, have open distal ends 224 and proximal ends which are slidably received onto the outer surfaces of respective ones of the flange portions 220. Thus, when attached to the housing 212, the handle members 222 extend perpendicularly relative the tubular member 202 in opposed relation.

As best seen in FIG. 5, disposed intermediate the interior chamber 214 of the housing 212 and the tubular member 202 is a check valve 226, which is shown in cross-section in FIG. 7(*a*). In the third embodiment, the check valve 226 is preferably a duck bill type valve which defines an enlarged, annular head portion 228 and a pair of flap portions 230 which permit the flow of fluid in the direction A shown in FIG. 7(*a*), but prevent the flow of fluid in the direction B. In the third embodiment, the check valve 226 is oriented such that the opening defined by the annular head portion 228 is coaxially aligned with the tubular passage defined by the bonnet portion 216. In this respect, the head portion 228 of the check valve 226 is preferably compressed between the outer rim 232 of the bonnet portion 216 and an annular lip 234 defined in the lower region of the internally threaded top end 204 such that the flap portions 230 extend downwardly into the tubular member 202. As will be recognized, due to its orientation, the check valve 226 allows water to flow from the interior chamber 214 into the tubular member 202, but prevents the backflow of water from the tubular member 202 into the interior chamber 214.

Disposed within the housing 212 intermediate the interior chamber 214 and the water supply source 210 is a water inlet valve 236,.which is shown in cross-section in FIG. 6(*a*). Similar to the check valve 226 previously described, the water inlet valve 236 includes an enlarged, annular head portion 238 having a resilient tubular portion 240 extending axially therefrom. Disposed within the tubular portion 240 are a pair of flap portions 242 which are normally closed and prevent the flow of fluid in the direction C when closed. In the third embodiment, the inlet valve 236 is oriented within the housing 212 in a manner wherein the bottom surface of the head portion 238 resides on an annular, bottom surface portion 244 of the bonnet portion 218, and the tubular portion 240 extends into and terminates within the interior chamber 214. As such, when the water supply source 210 is threadably engaged to the bonnet portion 218, the head portion 238 will normally be compressed between the supply source 210 and the bottom surface 244. Due to the orientation of the water inlet valve 236, the flow of water from the supply source 210 into the interior chamber 214 is blocked by the flap portions 242 when they are in the closed orientation, as seen in FIG. 6. Conversely, when the flap portions 242 are actuated to the open position, as seen in FIG. 7, the inlet valve 236 facilitates the flow of water from the supply source 210 into the interior chamber 214.

To facilitate the actuation of the water inlet valve 236, and more particularly the flap portions 242, to the open position, disposed within the housing 212 and cooperatively engaged to the tubular portion 240 of the inlet valve 236 is an actuation button 246. In the third embodiment, the actuation button 246 includes an enlarged, circularly configured head portion 248 having a lower, cylindrical portion 250 extending axially therefrom. As seen in FIGS. 5 and 6, the actuation button 246 is disposed in the housing 212 such that the head portion 248 is coaxially aligned with a complimentary recess 252 formed in the top of the housing 212, and the bottom surface 254 of the cylindrical portion 250 is abutted directly against the tubular portion 240 of the inlet valve 236. Importantly, the water inlet valve 236 is oriented within the housing 212 such that the bottom surface 254 of the cylindrical portion 250 is disposed directly above one of the opposed ends of the elongate seam defined by the closed ends of the flap portions 242. Due to this particular orientation of the inlet valve 236, the pressing, i.e. application of a downward force to, the head portion 248 of the actuation button 246 forces the bottom surface 254 downwardly into the resilient tubular portion 240, thus causing the flap portions 242 to open in the manner shown in FIG. 7. The opening of the flap portions 242 facilitates the flow of water through the tubular portion 240 of the water inlet valve 236 and into the interior chamber 214. In this respect, once the downward pressure exerted by the actuation button 246 opens the flap portions 242 thus allowing water to enter the interior chamber 214, the flap portions 242 are held open by the now greater water pressure on the inside edges thereof and the downward pressure of the actuation button 246 against the tubular portion 240. When fully actuated, the head portion 248 of the actuation button 246 resides within the recess 252 and is abutted against the bottom surface thereof. Due to the resiliency of the tubular portion 240, the removal of the downward force from the actuation button 246 causes the flap portions 242 to return to the center of the water stream and reassume the closed position and the head portion 248 to be biased back to its original upright position. Once the flap portions 242 are returned to direct contact with each other, thus defining the elongate seam, the water pressure on the outside edges of the flap portions 242 causes the same to form a tight seal, thus shutting off the flow of water. Thus, when the water supply source 210 is fluidly connected to the housing 212, water may be selectively channelled from the supply source 210 into the interior chamber 214 via the selective pressing of the actuation button 246.

In the third embodiment, the valve assembly 208 further comprises a pair of air inlet valves 256 which are identically configured and disposed intermediate the interior chamber 214 and respective ones of the handle members 222. The air inlet valves 256 are preferably umbrella type valves and include central portions 258 which are received into complementary apertures disposed within respective bottom walls 260 which separate the interiors of flange portions 220 from the interior chamber 214. Disposed within each of the bottom walls 260 are a plurality of vent apertures 262. As seen in FIG. 6, the ends of the apertures 262 which terminate into the interior chamber 214 are covered by the arcuately configured cap portion 264 of a respective air inlet valve 256. In this respect, each cap portion 264 has a circular configuration and includes a peripheral edge portion which is normally biased toward and abutted against the inner surface of a respective bottom wall 260 thus normally preventing the flow of ambient air through the handle members 222, flange portions 220 and apertures 262 into the interior chamber 214. The use of the air inlet valves 256 will be described in more-detail below.

Referring now to FIGS. 8(*a*)–8(*c*), attached to the bottom end 206 of the tubular member 202 is a plunger member 266 which is identically configured to the plunger members 28, 128 previously described. In this respect, the plunge member 266 includes a generally bell-shaped portion 268 having an annular lower surface 270, the peripheral edge of which is adapted to form a first seal S1 against a portion of the interior surface of the basin 32 surrounding the drain opening 30. Extending downwardly from the lower surface 270 is a generally cylindrical portion 272 having an outer diameter dimension exceeding the inner diameter dimension of the drain line 34 such that the cylindrical portion 272 forms a second seal S2 against the inner surface of the drain line 34 when received thereinto. Disposed in the bottom surface of the cylindrical portion 272 is a fluid outlet port.

In utilizing the plunger device 200, the water supply source 210 is fluidly coupled to the bonnet portion 218 of the valve assembly 208. Thereafter, the handle members 222 are grasped by the hands of the user, with the plunger member 266 being lowered to the drain opening 30 in the basin 32.

Advantageously, the cylindrical portion 272 of the plunger member 266 is adapted to be selectively invertible and disposed within the interior cavity 274 of the upper portion 268 when inverted, as shown in FIG. 8(*b*). In this respect, when the plunger member 266 is initially lowered to the drain opening 30, the cylindrical portion 272 is preferably pushed to the inverted orientation. The plunger device 200 is then manipulated so as to orient the inverted cylindrical portion 272 over the drain opening 30 and to abut the peripheral edge of the lower surface 270 against the inner surface of the basin 32, thus forming the first seal S1. Thereafter, the actuation button 246 is pressed by the thumb of one hand of the user, thus opening the flap portions 242 of the water inlet valve 236 in the previously described manner.

Water flowing from the supply source 210 into the interior chamber 214 via the inlet valve 236 exits the interior chamber 214 and enters the tubular member 202 via flow through the check valve 226 in the direction A. As will be recognized, flow through the check valve 226 in the direction A forces the flap portions 230 apart, thus allowing the water to flow into the tubular member 202. Water flowing downwardly through the tubular member 202 enters the interior cavity 274 of the plunger member 266, thus forcing the inverted cylindrical portion 272 downwardly into the drain opening 30 and hence the drain line 34, as seen in FIG. 8(*c*). Since the outer diameter dimension of the cylindrical portion 272 is less than the inner diameter dimension of the drain line 34, the forcing of the cylindrical portion 272 into the drain line 34 by the pressure of the water flowing through the plunger member 266 forms a tight second seal S2 in addition to the first seal S1 previously described.

As water is flowing from the supply source 210 into the drain line 34, constant downward pressure is applied to the handle members 222 by the user so as to maintain the peripheral edge of the lower surface 270 in sealed engagement with the interior surface of the basin 32. Due to the formation of the first and second seals S1, S2, water is forced into the drain line 34 at line pressure which in and of itself usually suffices to force the clog out of the drain line 34. In the event the line pressure of the supply source 210 does not cause the clog to be removed within the drain line 34, an additional volume of water may be forced thereinto in the same manner previously described with respect to the plunger member 28 of the first embodiment.

In certain instances when the plunger device 200 is being utilized, the line pressure in the water supply source 210 may decrease and create a vacuum, thus causing the pressure within the interior chamber 214 to fall below atmospheric pressure. This decreased pressure within the interior chamber 214 will allow water from within the drain line 34 to rise upwardly through the plunger member 266 and tubular member 202. To prevent inadvertent contamination of the fresh water supply in the event a vacuum is pulled within the supply source 210 and hence the interior chamber 214, the air inlet valves 256 are provided. Advantageously, a vacuum within the interior chamber 214 causes the cap portions 264 of the air inlet valves 256 to be pulled away from the inner surfaces of the bottom walls 260, thus allowing ambient air entering the handle members 222 via the open distal ends 224 thereof to enter the interior chamber 214 via the vent apertures 262, in the manner shown in FIG. 6. This channeling of ambient air into the interior chamber 214 allows the flap portions 242 of the inlet valve 236 which are normally held in the open position by the flow of water to assume the closed position. The creation of a vacuum within the interior chamber 214 also causes the flap portions 230 of the check valve 236 to assume the closed position, thus preventing the backflow of water from the tubular member 202 into the interior chamber 214.

Referring now to FIG. 9, illustrated is a plunger member 300 which may be utilized in conjunction with the plunger device 200 as an alternative to the plunger member 266 previously described. Though, in the following description, the plunger member 300 will be described as being used in the plunger device 300, it will be recognized that the plunger member 300 may also be utilized in conjunction with the plunger devices 100 and 200 constructed in accordance with the first and second embodiments of the present invention.

The plunger member 300 has a generally heart-shaped configuration and is attached to the bottom end 206 of the tubular member 202 in a manner which will be described in more detail below. The plunger member 300 includes an enlarged upper region 302 defining a downwardly directed annular lip 304 which is adapted to form a first seal S1 against a portion of the interior surface of the basin 32 surrounding the drain opening 30. The plunger member 300 further defines a cylindrically configured lower region 306 which is sized to be receivable into the drain line 34 in a manner wherein a portion of the lower region 306 intermediate the outlet port 308 thereof and the annular lip 304 forms a second seal S2 against the portion of the interior surface of the basin 32 defining the drain opening 30.

To facilitate the attachment of the plunger member 300 to the tubular member 202, received onto the bottom end 206 of the tubular member 202 are an upper nut 310 and a lower nut 312. The upper and lower nuts 310, 312, as well as the bottom end 206 of the tubular member 202, are specifically configured in a manner wherein the upper and lower nuts 310, 312 will not rotate when received onto the bottom end 206. Additionally, as seen in FIG. 9, the upper and lower nuts 310, 312, when properly positioned upon the bottom end 206, are configured to define an annular slot 314 which is adapted to receive an enlarged rim portion 316 of the upper region 302 in a non-releasable fashion.

In attaching the plunger member 300 to the tubular member 202, the upper nut 310 is initially positioned upon the tubular member 202 and slid axially therealong into abutment with a first annular shoulder 318 defined by the reduced diameter bottom end 206. Thereafter, the rim portion 316 of the upper region 302 is engaged to the upper nut 310 in the manner shown in FIG. 9, with the lower nut 312 then being positioned upon the tubular member 202 and slid axially therealong into abutment with a second annular shoulder 320 defined by the reduced diameter bottom end 206. As will be recognized, when the upper nut 310 is abutted against the first annular shoulder 318, and the lower nut 312 is abutted against the second annular shoulder 320, the rim portion 316 is captured within the annular slot 314 defined by the upper and lower nuts 310, 312. Attached to the lower nut 312 is a sink cup 322 which has a generally frusto-conical configuration and is maintained upon the lower nut 312 via the receipt of a radially extending flange portion 324 of the lower nut 312 into a corresponding recess 326 defined within the sink cup 322.

The plunger member 300 functions in a manner similar to the plunger members 266, 128 and 28 previously described. In this respect, during use of the plunger device 200 having the plunger member 300 interfaced thereto, the plunger member 300 is initially lowered to the drain opening 30 with the lower region 306 thereof being received into the drain line 34 and the annular lip 304 of the upper region 302 being abutted against the interior surface of the basin 32, thus forming the first and second seals S1, S2. As water is flowing from the supply source 210 into the drain line 34 via the outlet port 308 of the plunger member 300, constant downward pressure is applied to the handle members 222 by the user so as to maintain the annular lip 304 in sealed engagement with the interior surface of the basin 32. Due to the formation of the first and second seals S1, S2, water is forced into the drain line 34 at line pressure which in and of itself usually suffices to force the clog out of the drain line 34. In the event the line pressure of the supply source 210 does not cause the clog to be removed from within the drain line 34, an additional volume of water may be forced thereinto in the same manner previously described with respect to the plunger member 28 of the first embodiment.

Additional modifications and improvements of the present invention may also be apparent to those skilled in the art. Thus, the particular combination of parts described and illustrated herein is intended to represent only one embodiment of the invention, and is not intended to serve as limitations of alternative devices within the spirit and scope of the invention.

What is claimed is:

1. A plunger device for forcing waste through a drain line of a plumbing fixture, comprising:

an elongate, tubular member having top and bottom ends;

a valve assembly fluidly coupled to the top end of said tubular member and adapted to have a water supply source fluidly coupled thereto;

a pair of elongate, tubular handle members attached to said valve assembly in a manner wherein said handle members extend perpendicularly relative said tubular member in opposed relation; and a plunger member connected to the bottom end of said tubular member and defining an interior cavity which is in fluid communication with said tubular member, said plunger member further including a fluid outlet port and being sized and configured to cover and form a fluid-tight seal about a drain opening of said fixture in a manner wherein water is directed from said supply source, through said plunger device, and into said drain line via said outlet port;

said valve assembly comprising:

a housing defining an interior chamber;

a check valve disposed intermediate said interior chamber and said tubular member, said check valve being adapted to prevent the back-flow of water from said tubular member into said interior chamber;

a water inlet valve disposed intermediate said interior chamber and said water supply source, said inlet valve being adapted to channel water from said supply source to said interior chamber when actuated to an open position;

an actuation button disposed within said housing and cooperatively engaged to said water inlet valve in a manner wherein pressing said button is operable to actuate the inlet valve to the open position; and at least one air inlet valve disposed within said housing intermediate said interior chamber and a respective one of said handle members, said air inlet valve being operable to create a vacuum break and close said water inlet valve by placing said interior chamber in fluid communication with ambient air via said handle member when the fluid pressure in said interior chamber is less than atmospheric pressure; said valve assembly being selectively actuatable between open and closed positions, and operable to channel water from said supply source into said tubular member when in the open position.

2. The device of claim 1 wherein said water inlet and check valves are duck bill valves and said air inlet valve is an umbrella valve.

3. The device of claim 1 wherein said plunger member comprises:

a bell-shaped upper portion having an annular lower surface; and a generally cylindrical portion extending downwardly from said lower surface and having an outer diameter dimension exceeding the inner diameter dimension of said drain line such that said cylindrical portion forms a seal against the inner surface of said drain line when received thereinto, said outlet port being disposed within said cylindrical portion.

4. The device of claim 3 wherein said cylindrical portion is selectively invertible and disposed within said interior cavity when inverted, said cylindrical portion being initially inverted and caused to be moved to its original, extended orientation in a manner forming the seal against the inner surface of the drain line when the actuation button is pressed and water is directed through the plunger device.

5. The device of claim 1 wherein said plunger member comprises:

an upper region defining a downwardly directed annular lip adapted to form a first seal against an interior surface of the fixture; and a lower region sized and configured to be receivable into said drain line in a manner forming a second seal against an inner surface of said drain line when received thereinto, said outlet port being disposed within said lower region.

6. A plunger device for forcing waste through a drain line of a plumbing fixture, comprising:

an elongate, tubular member having top and bottom ends;

a valve assembly fluidly coupled to the top end of said tubular member and adapted to have water supply source fluidly coupled thereto;

a pair of elongate tubular handle members attached to said valve assembly; and a plunger member connected to the bottom end of said tubular member and defining an interior cavity which is in fluid communication with said tubular member, said plunger member further including a fluid outlet port and being sized and configured to cover and form a fluid-tight seal about a drain opening of said fixture in a manner wherein water is directed from said supply source, through said plunger device, and into said drain line via said outlet port;

said valve assembly comprising:

a housing defining an interior chamber;

a check valve disposed intermediate said interior chamber and said tubular member, said check valve being adapted to prevent the back-flow of water from said tubular member into said interior chamber;

a water inlet valve disposed intermediate said interior chamber and said water supply source, said water inlet valve being adapted to channel water from said supply source to said interior chamber when actuated to an open position; and at least one air inlet valve disposed within said housing intermediate said interior chamber and a respective one of said handle members, said air inlet valve being operable to create a vacuum break and close said water inlet valve by placing said interior chamber in fluid communication with ambient air via said handle member when the fluid pressure in said interior chamber is less than atmospheric pressure;

said valve assembly being selectively actuatable between open and closed positions, and operable to channel water from said supply source into said tubular member when in the open position.

7. The device of claim 6 wherein said water inlet and check valve is on duck bill valves and said air inlet valves are umbrella valve.

8. The device of claim 6 wherein said plunger member comprises:

a bell-shaped upper portion having an annular lower surface; and a generally cylindrical portion extending downwardly from said lower surface and having an outer diameter dimension exceeding the inner diameter dimension of said drain line such that said cylindrical portion forms a seal against the inner surface of said drain line when received thereinto, said outlet port being disposed within said cylindrical portion.

9. The device of claim 8 wherein said cylindrical portion is selectively invertible and disposed within said interior cavity when inverted, said cylindrical portion being initially inverted and caused to be moved to its original, extended orientation in a manner forming the seal against the inner surface of the drain line when water is directed through the plunger device.

10. The device of claim 6 wherein said plunger member comprises:

an upper region defining a downwardly directed annular lip adapted to form a first seal against an interior surface of the fixture; and a lower region sized and configured to be receivable into said drain line in a manner forming a second seal against an inner surface of said drain line when received thereinto, said outlet port being disposed within said lower region.

* * * * *